US010408445B1

(12) United States Patent
Hsu

(10) Patent No.: US 10,408,445 B1
(45) Date of Patent: Sep. 10, 2019

(54) CEILING LIGHTING ASSEMBLY WITH HIDDEN-TYPE SOUND DEVICE

(71) Applicant: Dong Guan Bright Yinhuey Lighting Co., Ltd. China, Guang Dong (CN)

(72) Inventor: Kevin Hsu, Taichung (TW)

(73) Assignee: Dong Guan Bright Yinhuey Lighting Co., Ltd. China, Guang Dong (CN)

( * ) Notice: Subject to any disclaimer, the term of this patent is extended or adjusted under 35 U.S.C. 154(b) by 0 days.

(21) Appl. No.: 15/942,627

(22) Filed: Apr. 2, 2018

(51) Int. Cl.

| | |
|---|---|
| ***F21V 33/00*** | (2006.01) |
| ***H04R 1/34*** | (2006.01) |
| ***H04R 1/02*** | (2006.01) |
| ***F21S 8/04*** | (2006.01) |

(52) U.S. Cl.
CPC ..... *F21V 33/0056* (2013.01); *F21S 8/046* (2013.01); *H04R 1/028* (2013.01); *H04R 1/345* (2013.01)

(58) Field of Classification Search
CPC ..... F21V 33/0056; F21S 8/046; H04R 1/345; H04R 1/028
See application file for complete search history.

(56) References Cited

U.S. PATENT DOCUMENTS 9,408,282 B1 * 8/2016 Springer ..... H05B 37/0272
9,739,472 B1 * 8/2017 Li ..... F21V 29/70
2013/0308315 A1 * 11/2013 Capitani ..... F21V 33/0056 362/253
2014/0199168 A1 * 7/2014 Spiro ..... F04D 29/582 416/5
2014/0355246 A1 * 12/2014 Yotsumoto ..... H04R 1/028 362/86
2015/0249777 A1 * 9/2015 Chen ..... H04N 5/2257 348/151
2016/0010846 A1 * 1/2016 Wu ..... F21V 33/0056 381/334
2016/0061438 A1 * 3/2016 Lu ..... F21V 33/0056 362/86
2016/0119459 A1 * 4/2016 Clementson ..... H04M 1/22 379/396
2016/0334082 A1 * 11/2016 Chen ..... F21V 17/002
2017/0211750 A1 * 7/2017 Yotsumoto ..... F21S 2/00
2017/0332166 A1 * 11/2017 Kikuchi ..... H04R 1/24
2018/0023802 A1 * 1/2018 Duque ..... F21V 33/0056 362/413
2018/0051872 A1 * 2/2018 Ivey ..... F21V 33/0056
2018/0352313 A1 * 12/2018 Hsu ..... H04R 1/028
2019/0110115 A1 * 4/2019 Yokosawa ..... F21V 33/0056

* cited by examiner

*Primary Examiner* — Donald L Raleigh
(74) *Attorney, Agent, or Firm* — Alan D. Kamrath; Mayer & Williams PC

(57) ABSTRACT

A ceiling light assembly includes a base, a first illuminating module mounted on the base, a support unit mounted on the base, a second illuminating module mounted on the support unit, and an audio device mounted on the support unit. The first illuminating module surrounds the support unit. The second illuminating module is located under the audio device and is exposed outward from the support unit. Thus, the audio device is hidden in the interior of the ceiling light assembly and is not directly exposed to the ambient environment, so that the audio device is invisible during the audio playing process, to prevent the user from directly seeing the audio device.

4 Claims, 3 Drawing Sheets

CEILING LIGHTING ASSEMBLY WITH HIDDEN-TYPE SOUND DEVICE

BACKGROUND OF THE INVENTION

1. Field of the Invention

The present invention relates to a lighting apparatus and, more particularly, to a ceiling light assembly.

2. Description of the Related Art

A conventional ceiling fitting comprises a housing secured on a ceiling, a light emitting element mounted in the housing, and a cover mounted on the housing to cover the light emitting element. Thus, the ceiling fitting is attached to the ceiling so as to provide a lighting function. However, the conventional ceiling fitting does not have a sound playing function. A conventional sound device is mounted on a wall to provide an audio playing function. However, the conventional sound device does not have an illuminating function. In addition, the ceiling fitting and the sound device are mounted independently, thereby wasting the mounting space, and thereby causing inconvenience to the user in assembly of the ceiling fitting and the sound device. Further, the ceiling fitting and the sound device are arranged respectively and are not integrated, thereby decreasing the aesthetic quality thereof Further, the ceiling fitting and the sound device are assembled respectively, thereby complicating the wiring work of the ceiling fitting and the sound device.

BRIEF SUMMARY OF THE INVENTION

The primary objective of the present invention is to provide a ceiling light assembly with a hidden-type sound device.

In accordance with the present invention, there is provided a ceiling light assembly comprising a base, a first illuminating module mounted on the base, a support unit mounted on the base, a second illuminating module mounted on the support unit, and an audio device mounted on the support unit. The first illuminating module surrounds the support unit. The second illuminating module is located under the audio device and is exposed outward from the support unit. The audio device is hidden in an interior of the ceiling light assembly.

Preferably, the support unit includes a bottom support and a top support mounted on the bottom support. The bottom support and the top support form a receiving space. The second illuminating module is mounted on a bottom of the bottom support. The bottom support is provided with a plurality of sound guiding holes. The sound guiding holes of the bottom support are connected to an exterior of the ceiling light assembly and an interior space of the support unit.

Preferably, the sound guiding holes of the bottom support surround the second illuminating module. The sound guiding holes of the bottom support present an arcuate arrangement and are coaxial with each other.

Preferably, the base has a bottom face having a central position provided with a locking hole, and the bottom support of the support unit has a bottom having a periphery provided with a locking groove which is locked with a rim of the locking hole of the base. Thus, the bottom support of the support unit is limited by the rim of the locking hole of the base.

According to the primary advantage of the present invention, the audio device is hidden in the interior of the ceiling light assembly and is not directly exposed to the ambient environment, so that the audio device is invisible during the audio playing process, to prevent the user from directly seeing the audio device, thereby enhancing the aesthetic quality of the ceiling light assembly.

According to another advantage of the present invention, the ceiling light assembly has a compact structure and saves the wiring space.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
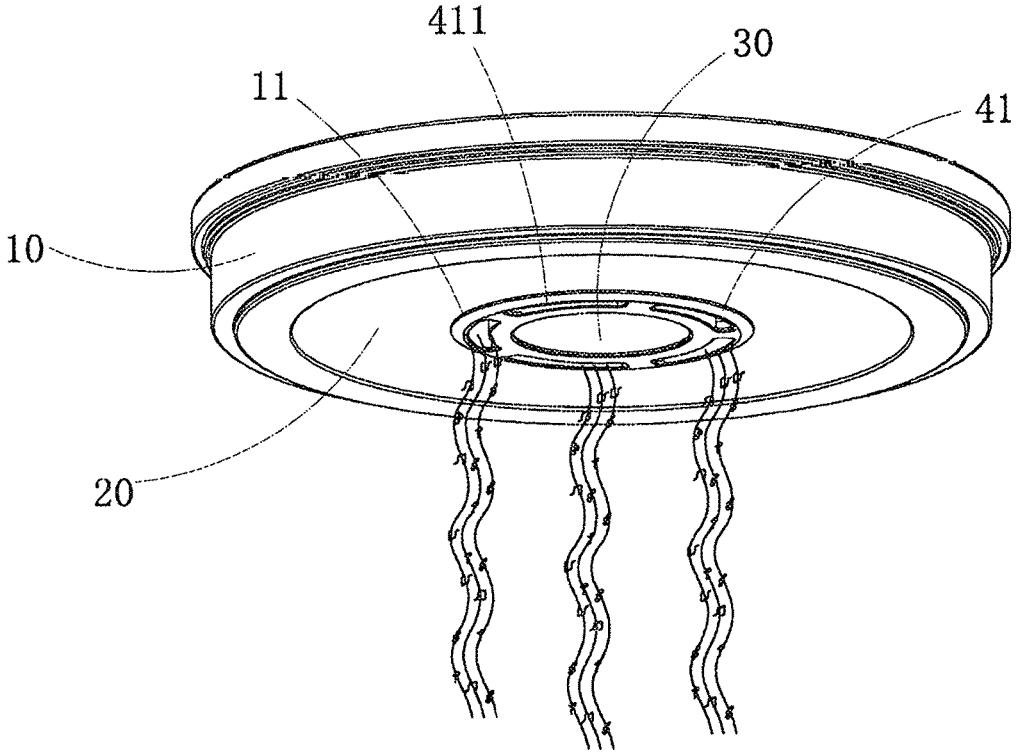
FIG. 1 is a perspective view of a ceiling light assembly in accordance with the preferred embodiment of the present invention.
Figure 2:
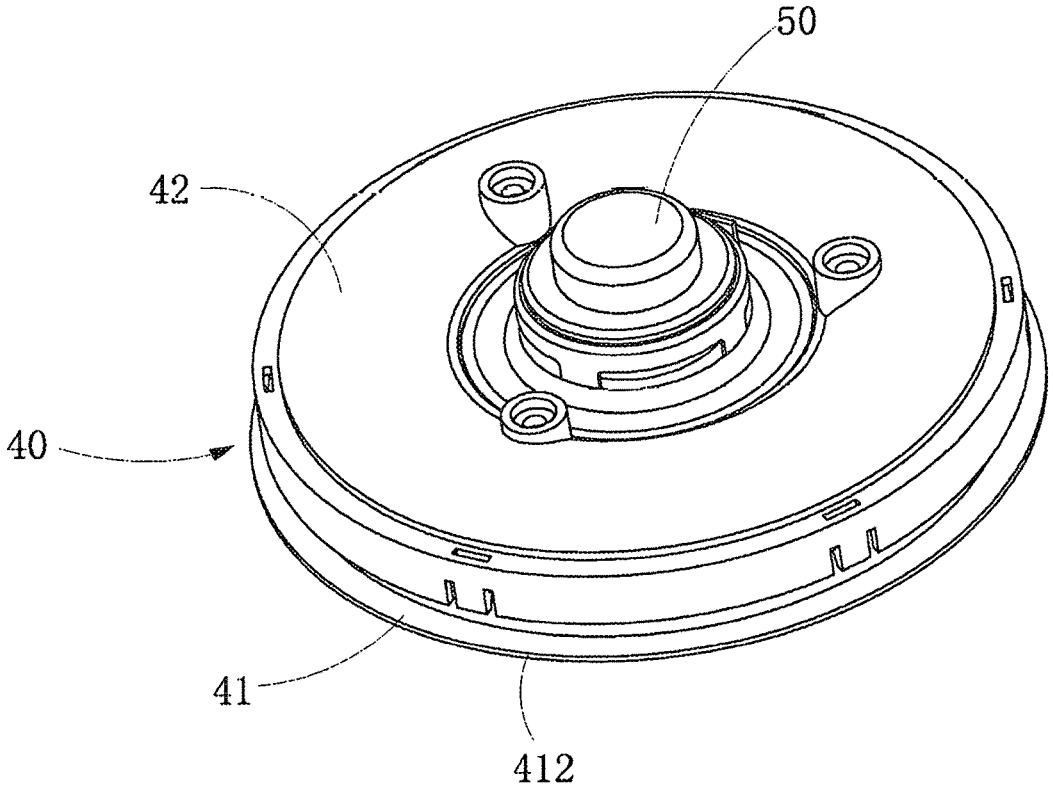
FIG. 2 is a partially perspective view of the ceiling light assembly in accordance with the preferred embodiment of the present invention.
Figure 3:
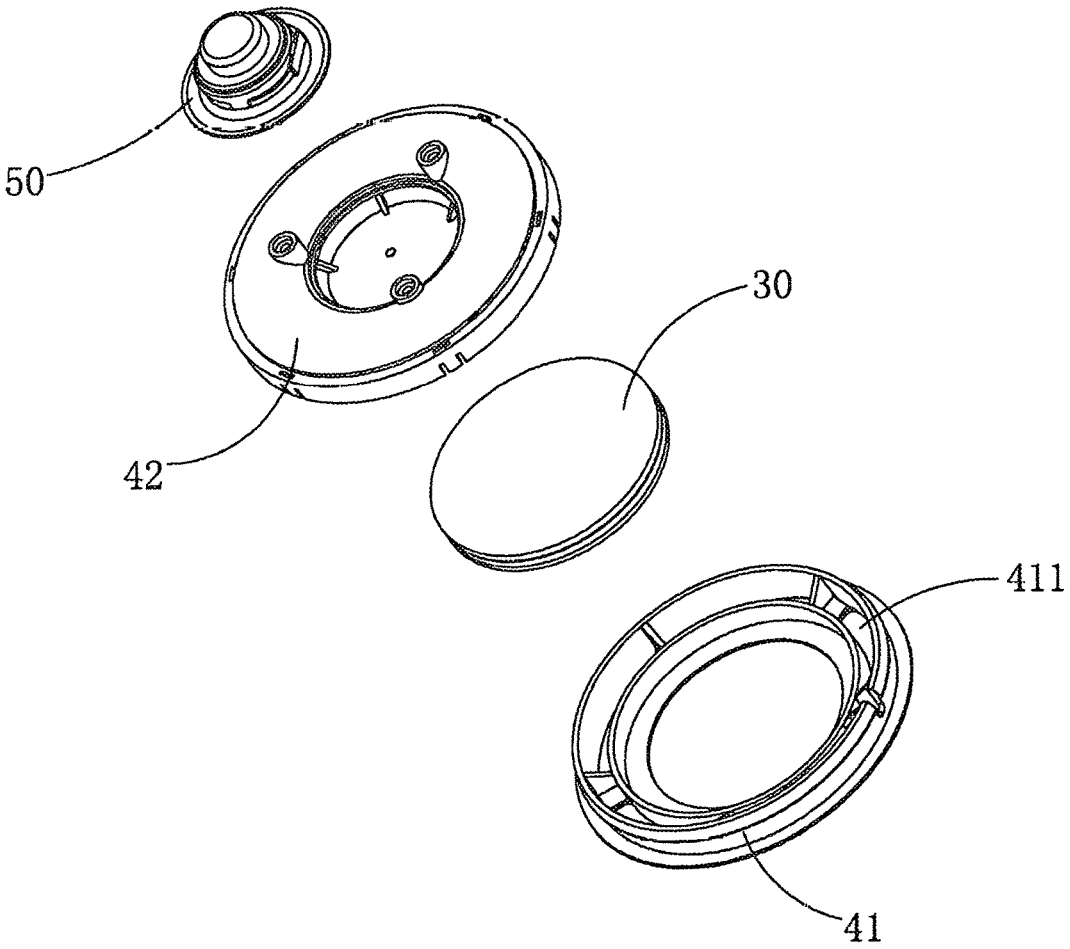
FIG. 3 is an exploded perspective view of the ceiling light assembly as shown in FIG. 2.

Referring to FIGS. 1-3, a ceiling light assembly in accordance with the preferred embodiment of the present invention comprises a base 10, a first illuminating module 20 mounted on the base 10, a support unit 40 mounted on the base 10, a second illuminating module 30 mounted on the support unit 40, and an audio device 50 mounted on the support unit 40. The first illuminating module 20 surrounds the support unit 40. The second illuminating module 30 is located under the audio device 50 and is exposed outward from the support unit 40. The audio device 50 is hidden in an interior of the ceiling light assembly.

In the preferred embodiment of the present invention, the support unit 40 includes a bottom support 41 and a top support 42 mounted on the bottom support 41. The bottom support 41 and the top support 42 form a receiving space for receiving the second illuminating module 30. The second illuminating module 30 is mounted on a bottom of the bottom support 41. The bottom support 41 is provided with a plurality of sound guiding holes 411. The sound guiding holes 411 of the bottom support 41 are connected to an exterior of the ceiling light assembly and an interior space of the support unit 40.

In the preferred embodiment of the present invention, the sound guiding holes 411 of the bottom support 41 surround the second illuminating module 30. The sound guiding holes 411 of the bottom support 41 present an arcuate arrangement and are coaxial with each other.

In the preferred embodiment of the present invention, the base 10 has a bottom face having a central position provided with a locking hole 11, and the bottom support 41 of the support unit 40 has a bottom having a periphery provided with a locking groove 412 which is locked with a rim of the locking hole 11 of the base 10. Thus, the bottom support 41 of the support unit 40 is limited by the rim of the locking hole 11 of the base 10.

In operation, the first illuminating module 20, the second illuminating module 30 and the audio device 50 work independently. In such a manner, the ceiling light assembly provides illuminating and audio playing functions simultaneously by provision of the first illuminating module 20, the second illuminating module 30 and the audio device 50.

Accordingly, the audio device 50 is hidden in the interior of the ceiling light assembly and is not directly exposed to the ambient environment, so that the audio device 50 is invisible during the audio playing process, to prevent the user from directly seeing the audio device 50, thereby enhancing the aesthetic quality of the ceiling light assembly. In addition, the ceiling light assembly has a compact structure and saves the wiring space.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ceiling light assembly comprising:

a base;

a first illuminating module mounted on the base;

a support unit mounted on the base;

a second illuminating module mounted on the support unit; and an audio device mounted on the support unit;

wherein:

the first illuminating module surrounds the support unit;

the second illuminating module is located under the audio device and is exposed outward from the support unit; and the audio device is hidden in an interior of the ceiling light assembly.

2. The ceiling light assembly of claim 1, wherein:

the support unit includes a bottom support and a top support mounted on the bottom support;

the bottom support and the top support form a receiving space;

the second illuminating module is mounted on a bottom of the bottom support;

the bottom support is provided with a plurality of sound guiding holes; and the sound guiding holes of the bottom support are connected to an exterior of the ceiling light assembly and an interior space of the support unit.

3. The ceiling light assembly of claim 2, wherein:

the sound guiding holes of the bottom support surround the second illuminating module; and the sound guiding holes of the bottom support present an arcuate arrangement and are coaxial with each other.

4. The ceiling light assembly of claim 1, wherein:

the base has a bottom face having a central position provided with a locking hole;

the bottom support of the support unit has a bottom having a periphery provided with a locking groove which is locked with a rim of the locking hole of the base; and the bottom support of the support unit is limited by the rim of the locking hole of the base.

* * * * *